US005808224A

United States Patent [19]

Kato

[11] Patent Number: 5,808,224

[45] Date of Patent: Sep. 15, 1998

[54] PORTABLE DOWNLOADER CONNECTABLE TO KARAOKE PLAYER THROUGH WIRELESS COMMUNICATION CHANNEL

[75] Inventor: Hirokazu Kato, Hamamatsu, Japan

[73] Assignee: Yamaha Corporation, Hamamatsu, Japan

[21] Appl. No.: 819,472

[22] Filed: Mar. 17, 1997

Related U.S. Application Data

[63] Continuation of Ser. No. 294,314, Aug. 23, 1994, abandoned.

[30] Foreign Application Priority Data

Sep. 3, 1993 [JP] Japan ..... 5-243769
Dec. 28, 1993 [JP] Japan ..... 5-335806

[51] Int. Cl.[6] ..... A63H 5/00; G04B 13/00; G10H 7/00

[52] U.S. Cl. ..... 84/609; 84/644; 434/307 A; 206/307; 206/457

[58] Field of Search ..... 84/600, 601, 609, 84/610, 634, 644, 645, 670; 434/307 A; 395/442; 206/307, 457

[56] References Cited

U.S. PATENT DOCUMENTS 5,046,004 9/1991 Tsumura et al. ..... 84/645
5,127,303 7/1992 Tsumura et al. ..... 84/645
5,252,775 10/1993 Urano ..... 84/645
5,296,641 3/1994 Stelzel ..... 84/645
5,335,073 8/1994 Yamamoto ..... 84/601
5,408,686 4/1995 Mankovitz .
5,518,408 5/1996 Kawashima et al. ..... 84/609 X

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

A karaoke system has a player for presenting a karaoke accompaniment according to a song data selected in response to a request, and a loader coupled to the player for downloading thereinto a song data. The loader is comprised of a casing having a first face, one coupling member disposed in the first face, a primary storage disposed in the casing for storing a plurality of song data, and a transmitter for retrieving the song data from the primary storage to transmit the same through the one coupling member. The player is comprised of a housing having a second face arranged such as to confront the first face when the loader is placed in a coupled state with the player, another coupling member disposed in the second face in opposed relation to the one coupling member to thereby form a wireless coupler under the coupled state, a secondary storage disposed in the housing, a receiver for receiving the song data transmitted through the wireless coupler to store the same into the secondary storage, and a sound synthesizer responsive to a request for selectively retrieving a desired song data from the secondary storage so as to sound the karaoke accompaniment.

8 Claims, 9 Drawing Sheets

PORTABLE DOWNLOADER CONNECTABLE TO KARAOKE PLAYER THROUGH WIRELESS COMMUNICATION CHANNEL

This application is a continuation of application Ser. No. 08/294,314, filed Aug. 23, 1994, now abandoned.

BACKGROUND OF THE INVENTION

The present invention generally relates to an amusement system comprised of a main playing machine for presenting a play according to a given program, and a separate loading machine connectable to the main playing machine for downloading thereinto a data and/or a program. The present invention specifically relates to a karaoke system comprised of a karaoke playing machine for presenting a karaoke play according to a given song data, and a separate loading machine for downloading a song data of a newly released song or other entry songs into the karaoke playing machine.

A computer amusement machine has various types such as a TV game player, an electronic musical instrument of a tone synthesis type, and a karaoke player of a tone synthesis type. The amusement machine or the player executes a given computer program to display a picture on a monitor and to produce a sound from a loudspeaker. Such a type of the amusement machine has a fixed hardware construction, but can present different items of game plays or different items of music plays by changing the program and data. For example, a game data or a game program can be changed in the game playing machine. A song data or a tone control parameter data can be changed in the karaoke playing machine.

In a simpler form, a data record medium such as a magnetic tape cassette and a floppy disk is directly set into the main amusement machine to supply thereto a desired data or program. In a more complicated form, a data loading machine having a greater memory capacity is provided separately from the main amusement machine for downloading thereinto a heavy volume of information containing data and/or program. Such a type of the data loading machine or loader is prepared in multiple numbers for downloading different items of information into the individual player.

The conventional data loader is mechanically coupled to the player through a cable or else so that the player requires a connector or an adapter which would complicate a construction. Further, cable connecting work is required before the data downloading, hence handling of the loader is rather laborious. In addition, the mechanical coupling structure inherently restricts a shape and appearance of the loader such that the conventional loader has a uniform shape and appearance regardless of the contained information items, which would cause confusion.

Specifically referring to the karaoke player which is widely spread to provide a musical amusement, a new karaoke song is introduced routinely at a pace of about five pieces a week as a software source of the karaoke player. Therefore, in case that the karaoke playing machine is installed for providing commercial services in a facility such as a specialized rental room so called "karaoke box" or a bar and club, the karaoke entry songs must be periodically updated to satisfy needs of vast customers. In this regard, the most popular karaoke playing machine of a reproduction type such as "Laser Karaoke" utilizes a record medium composed of an optical disk (Laser Disc) which records about 20 pieces of karaoke songs together with lyric information and background picture information. A new optical disk is routinely added or replaces an old optical disk so as to update the entry karaoke songs.

On the other hand, a recently developed karaoke playing machine of a synthesis type utilizes a tone generator for electronically synthesizing a musical tone signal, and a hard disk memory device (HDD) for storing numerous pieces of song data such that a desired song data is read out from the installed HDD to drive the tone generator to thereby present a karaoke accompaniment. Generally, the HDD can reserve several hundreds through several thousands of song data files, hence the updating of the entry songs can be carried out by downloading new song data files into the HDD. The karaoke players of the synthesis type is initially stored with several hundreds of song data files at the time of factory shipment. The produced machine is delivered to a user with a certain time delay, hence an initial updating is required at the delivery in addition to the routine updating.

An online system is developed to serve a new song data such that a host station is connected to a local terminal of the karaoke machine through a telephone line network such as Integrated Services Digital Network (ISDN) to directly download the song data, as disclosed in, for example, Japanese Patent Application No. 5-77637. However, such an online system is not advantageous for a compact and cheap model of the karaoke playing machine, because installation of ISDN and equipment of ISDN interface are too costly for the compact and cheap player. Therefore, practically, a downloading machine storing a new song data file is utilized in place of the online karaoke network system such that the portable downloading machine is connected to a stand-alone karaoke playing machine of the compact and cheap model to effect updating of the entry songs.

The conventional downloader is generally coupled to the karaoke player through an SCSI cable. However, the connection of the SCSI cable must be handled carefully. Even a slight contact failure may cause a data transfer error when a great volume of files is transferred at a higher rate in the order of several Mbps. Particularly, in a public facility such as a bar and a club, the karaoke player suffers from contamination and moisture, which would cause a contact failure, resulting in frequent data transfer errors. Further, the SCSI connector is normally disposed on a back face of the karaoke playing machine. Therefore, the karaoke playing machine must be drawn from a console to expose the SCSI connector on the back face for connection to the SCSI cable everytime the entry karaoke songs are to be updated. Such a handling is quite laborious. Alternatively, the SCSI connector may be disposed on a front face of the karaoke playing machine to facilitate the connection to the loading machine. However, such an arrangement suffers from a poor appearance in the public facility. A permanent connection of the SCSI cable to the SCSI connector on the back face likewise suffers from a poor appearance.

SUMMARY OF THE INVENTION

In view of the drawbacks of the prior art, an object of the invention is to provide quick and reliable coupling of a data loader to a karaoke player. Another object of the invention is to provide a data loader which can readily indicate contents thereof.

According to one aspect of the invention, a karaoke system comprises a player for presenting a karaoke accompaniment according to a song data selected in response to a request, and a loader coupled to the player for downloading thereinto a song data. The loader comprises a casing having a first face, one coupling member disposed in the first face, a primary storage disposed in the casing for storing a plurality of song data, and transmitter means for retrieving the song data from the primary storage to transmit the same through said one coupling member. The player comprises a housing having a second face arranged such as to confront the first face when the loader is placed in a coupled state with the player, another coupling member disposed in the second face in opposed relation to said one coupling member to thereby form a wireless coupler under the coupled state, a secondary storage disposed in the housing, receiver means for receiving the song data transmitted through the wireless coupler to store the same into the secondary storage, and sound means responsive to a request for selectively retrieving a desired song data from the secondary storage so as to sound the karaoke accompaniment.

In a preferred form, the karaoke system includes means provided in either of the player and the loader for checking contents of the primary storage and the secondary storage to discriminate a new song data which is stored in the primary storage but not stored in the second storage, and for controlling the transmitter means to selectively transmit the new song data from the loader to the player through the wireless coupler. Further, the karaoke system includes an additional wireless coupler of a two-way type formed between the player and the loader for exchanging a control message effective to control the downloading of the song data.

According to another aspect of the invention, an amusement system comprises a player for presenting a play according to information containing a program and/or a data, and a plurality of loaders selectively coupled to the player for downloading different items of the information. Each loader comprises a storage medium for storing one item of the information, a casing for accommodating therein the storage medium and being formed in a peculiar shape associated to the item of the stored information, one coupling member disposed on the casing, and transmitter means for transmitting the item of the information stored in the storage medium through said one coupling member. The player comprises another coupling member arranged such as to confront said one coupling member to thereby form a wireless coupler when a selected one of the loaders is coupled to the player, receiver means for receiving the transmitted item of the information through the wireless coupler, and processing means for processing the received item of the information to present a desired kind of the play. In a practical form, the processing means of the player comprises means for selectively presenting one of a karaoke play, a TV game play and an instrument play according to the downloaded item of the information.

In operation of the karaoke system composed of the data loader and the karaoke player, the loader transmits the song data stored in the primary storage through the wireless coupler, such that the song data is modulated into an optical signal or an electromagnetic signal. Namely, a carrier of optical wave or electromagnetic wave is modulated by the song data, and is emitted from the coupling member such as an LED or a semiconductor laser, or an antenna. On the other hand, the karaoke player receives the optical or electromagnetic signal through the wireless coupler to store the carried song data into the secondary storage. Further, the player reads out the song data from the secondary storage to sound the karaoke accompaniment in response to a request by a singer. The one coupling member disposed in the face of the loader casing transmits the optical or electromagnetic signal, while the other coupling member disposed in the face of the player housing receives the optical or electromagnetic signal. When the loader is mounted vertically on the player, or set adjacently to the player, the pair of the coupling members confront with each other in face to face relation to form the wireless coupler. For example, the one coupling member is disposed in a bottom face of the loader casing, while the counter coupling member is disposed in a top face of the player housing. Otherwise, the one coupling member is disposed in a rear face of the loader casing, while the counter coupling member is disposed in a front face of the player casing. By such a construction, the data loader is simply set on the karaoke player to carry out the data transfer through the wireless coupler. In a practical form, the contents of the primary and secondary storages are compared with each other to discriminate a new song data which is stored in the primary storage but not yet stored in the secondary storage. The discriminated song data is transferred from the loader to the player. In another practical form, the additional wireless coupler of a two-way type or bidirectional type is formed in parallel to the main wireless coupler. A pair of Universal Asynchronous Receiver Transmitter (UART) devices are utilized to form the additional wireless coupler between the loader and the player. The two-way wireless coupler is used to exchange various control messages other than the song data to establish handshake between the loader and the player, or otherwise to exchange a list of the song data to be downloaded. By such a manner, the control message is transferred bidirectionally through the additional wireless coupler, while the song data is transferred unidirectionally through the main wireless coupler which can be composed of a pair of transmitter and receiver having a fast transfer rate of one-way mode with a great volume capacity.

In operation of the inventive amusement system composed of the player and the plurality of the spare loaders, each loader transmits the information containing data and/or program by a carrier radio wave of a quite weak power. Therefore, it is not necessary to mechanically connect the loader to the player. Consequently, the casing of each spare loader can be freely designed in a peculiar shape associated to the item of the stored information, thereby readily selecting a desired spare loader according to its shape or appearance. The loader can be readily and spatially coupled to the player without laborious physical connecting work. Connectors can be eliminated to thereby simplify the construction of the system.

DETAILED DESCRIPTION OF THE INVENTION

Figure 1A:
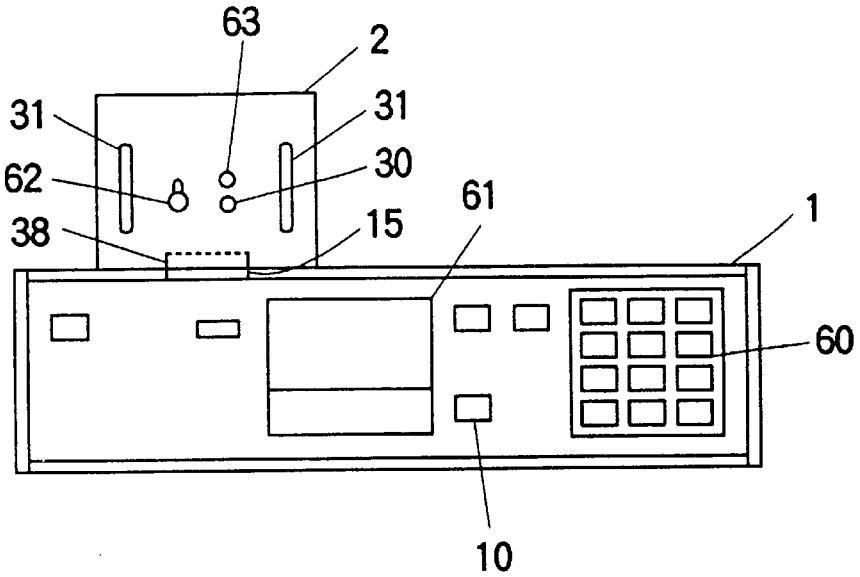
FIGS. 1A and 1B show an overall construction of one embodiment of the inventive karaoke system.
Figure 1B:
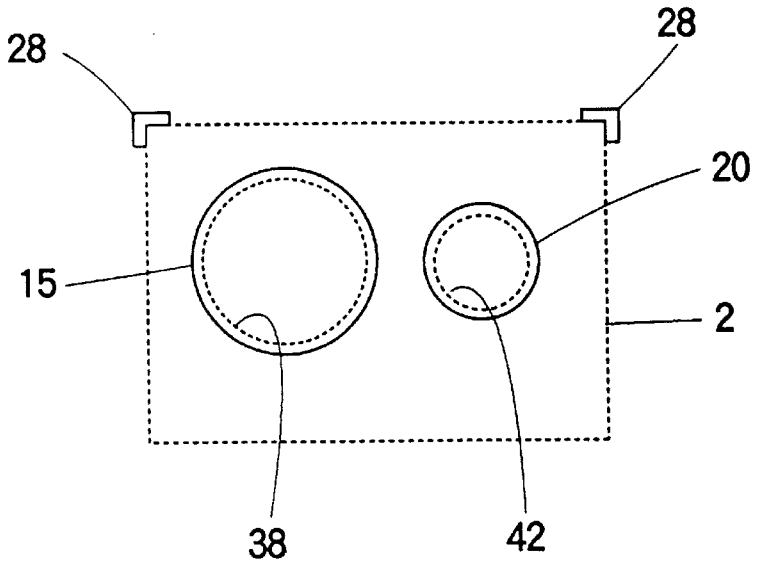

Referring to FIGS. 1A and 1B, the inventive karaoke system is comprised of a karaoke playing machine or karaoke player 1 and a song data loading machine or data loader 2. As shown in FIG. 1A, the karaoke player 1 is provided with a request switch 60 and a request display 61 on a front operating panel which is fitted into a housing of the karaoke player 1. Further, an enabling switch 10 is provided on the front operating panel for commencing downloading of a song data of a new entry song from the data loader 2. On the other hand, the loader 2 is provided with a power switch 62 and a power indicator 63 on a front operating panel which is fitted into a casing of the loader 2. Further, a downloading indicator 30 is provided on the front operating panel for indicating downloading operation of the song data. Additionally, a pair of grips 31 are fixed to the casing for handling or carrying. The loader 2 is mounted on the player 1 during the downloading of the song data.

As shown in FIG. 1B, one coupling member 15 composed of a photodetector such as an infrared photodiode is disposed on a top face of the housing of the karaoke player. An additional coupling member 20 composed of a photoelectric converter such as a combination of an infrared light emitting diode (LED) and an infrared photodiode is disposed adjacently to the main coupling member 15. The coupling member 15 unidirectionally operates to receive a great volume of data such as the song data at a fast transfer rate (several Mbps) from the data loader 2. The additional coupling member 20 bidirectionally operates to exchange a control message to and from the data loader 2 for handshaking. These coupling members 15, 20 are fitted into openings formed in the metal housing, and are covered by a red resin material. The red resin material has a flat surface in the same level as that of the top face of the housing.

The loader 2 is mounted on the player 1. A bottom face of the casing of the loader 2 is indicated by a dashed rectangle in FIG. 1B. As shown in FIG. 1B, the top face of the player housing is formed with a pair of guide pieces 28 having an L-shape so as to set the loader 2 in place when the same is mounted on the player 1. Another coupling member 38 (shown as a dashed circle) composed of a photoemitter is disposed in the bottom face of the loader casing such as to confront the one coupling member 15 (shown as a solid circle) in registration with each other to form a main wireless coupler of the one-way type. Further, another additional coupling member 42 composed of a photoemitter and a photodetector (shown as a dashed circle) is disposed on the same bottom face of the loader casing such as to confront the additional coupling member 20 (shown as a solid circle) in registration with each other to form an additional wireless coupler of the two-way type. The guide pieces 28 may be eliminated if the respective coupling members have a sufficient area to allow a rough alignment between the loader and the player as long as the data transfer is held safely through the wireless couplers.

In operation of the downloading of the song data from the data loader 2 to the karaoke player 1, firstly the loader 2 is set on the player 1 as positioned by the guide pieces 28, and the power switch 62 is turned on. Then, the enabling switch 10 of the karaoke player 1 is turned on so that the additional wireless coupler is opened by the pair of the opposing coupling members 20, 42 to establish a handshake between the loader and the player to thereby automatically carry out the song data downloading through the main wireless coupler formed of the pair of the opposing coupling members 15, 38. During the course of the downloading operation, the indicator 30 is lighted. When the downloading operation is finished, this indicator 30 is switched off. Thereafter, the power switch 62 of the loader 2 is turned off, and the portable loader 2 is removed from the karaoke player 1 by means of the grips 31 to thereby finish the downloading work.

Figure 2:
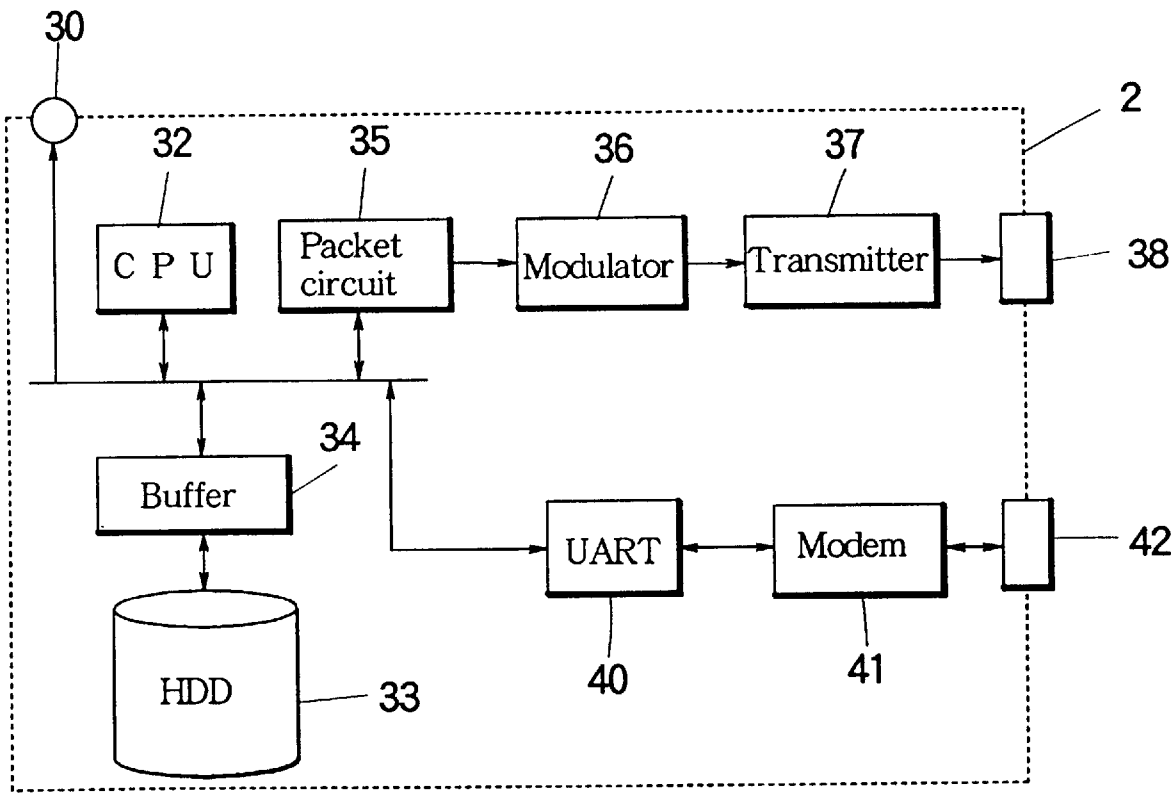
FIG. 2 is a block diagram showing a data loader contained in the inventive karaoke system.

Referring to FIG. 2, the data loader 2 is constructed to transmit a file of the song data in a packet format at the transfer rate in the order of 105 Mbps through 8 Mbps. The loader 2 includes a primary storage composed of a hard disk memory device (HDD) 33 for storing new entry song data and else. The HDD 33 is connected to a bus line through a buffer 34. The loader 2 further includes a CPU 32, a packet circuit 35, a universal asynchronous receiver transmitter (UART) 40 and a downloading indicator 30, all of which are linked together through the bus line. A series of a modulator 36, a transmitter 37 and a photoemitting coupling member 38 is connected succeedingly to the packet circuit 35 so as to constitute a fast one-way channel. Another series of an infrared modem 41 and a photoemitting/photodetecting coupling member 42 is connected succeedingly to the UART 40 so as to constitute a slow two-way channel having a transfer rate of about 9600 bps.

The packet circuit 35 divides one file of the song data retrieved from the HDD 33, into serial blocks each containing 2048 bytes of data so that each block is added with a header, parity bits and else to form a packet. The modulator 36 receives the packet and modulates the same according to Eight to Fourteen Modulation (EFM) method. In the EFM method, an eight-bit data is converted into a set of fourteen channel bits such that the maximum inversion interval is set narrowly and the minimum inversion interval is set widely while a DC component is reduced. Such a packet format and its modulation by EFM are commonly adopted in CD-ROM system. The transmitter 37 amplifies an electric signal obtained by the modulation of the song data according to the EFM method, so as to drive the photoemitting coupling member 38. The photoemitting coupling member 38 is composed of a highly efficient infrared LED which is driven intermittently by the amplified electric signal to thereby emit an equivalent infrared optical signal directed to the counterpart coupling member 15 of the karaoke player.

The UART 40 converts a parallel bit data fed from the CPU 32 through the bus line, into a corresponding serial bit data which is added with a start bit, a stop bit and a parity bit. The converted serial bit data is outputted to the infrared modem 41. The UART 40 reversely receives the serial bit data from the infrared modem 41, and detects therefrom a start bit with error checks to convert the serial bit data into a corresponding parallel bit data. The infrared modem 41 modulates the serial bit data inputted from the UART 40 by Frequency Shift Keying (FSK) method. The FSK method uses a variable frequency oscillator which operates when a pulse is inputted as a bias to shift the oscillating frequency thereof in response to the inputted pulses. The modulated results are outputted to an LED contained in the photoemitting/photodetecting coupling member 42. The modem 41 further operates to demodulate an electric signal detected by an infrared photodiode of the coupling member 42, into a corresponding serial bit data. Such a two-way channel is utilized to exchange a control message and else between the loader 2 and the player 1.

The CPU 32 of the loader communicates with a counterpart CPU of the player 1 through the two-way channel so as to determine files of the song data to be downloaded. The CPU 32 retrieves the song data file from the HDD 33 through the buffer 34 to output the same to the packet circuit 35. The packet circuit 35 divides the song data file to form packets which are fed to the modulator 36. The modulator 36 modulates the packets by the EFM method to output a corresponding electric signal to the transmitter 37. The transmitter 37 amplifies the electric signal, which is then inputted into the photoemitting coupling member 38. The photoemitting coupling member 38 is driven intermittently by the inputted electrical signal to emit an equivalent infrared optical signal which is directed to the opposed photodetecting coupling member 15 of the karaoke player 1.

Figure 3:
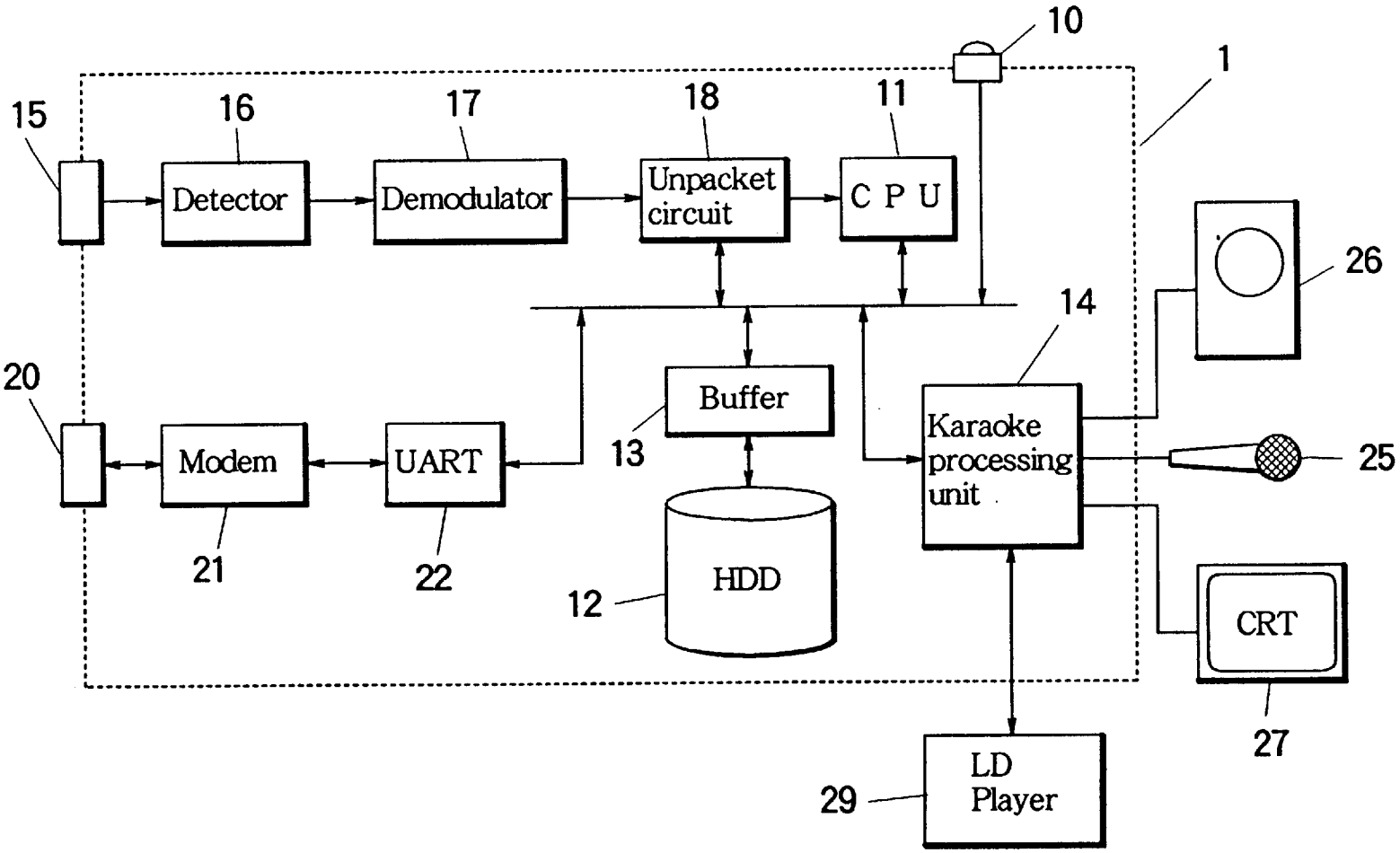
FIG. 3 is a block diagram showing a karaoke player contained in the inventive karaoke system.

Referring to FIG. 3, the karaoke player 1 is comprised of a CPU 11, an enabling switch 10, a karaoke processing unit 14, an unpacket circuit 18 and a UART 22, all of which are interconnected to each other through a bus line. Further, a secondary storage composed of an HDD 12 is connected to the bus line through a buffer 13. The HDD 12 stores several hundreds to several thousands of song data files. Further, the HDD 12 memorizes a directory file which is a list of identification codes of the stored song data files. The CPU 11 searches the directory file according to an inputted request to select a desired file of the song data from the HDD 12. A series of a demodulator 17, a detector 16 and a receiving coupling member 15 are connected precedingly to the unpacket circuit 18 to constitute a fast one-way channel. A series of an infrared modem 21 and a photoemitting/photodetecting coupling member 20 are connected precedingly to the UART 22 so as to constitute an additional two-way channel.

The photodetecting coupling member 15 is composed of a highly sensitive infrared photodiode which generates by a reverse bias a photoelectric current varying in response to an intensity of the received infrared optical signal. The detector 16 detects the photoelectric current to extract therefrom an EFM signal which is a modulated form of the song data packet and which is inputted into the demodulator 17. The demodulator 17 demodulates the EFM signal into the data packet of a base band, a modulated result of which is inputted into the unpacket circuit 18. The unpacket circuit 18 processes the inputted data packet to remove therefrom the header, the parity bit or else to restore the original song data.

The UART 22 converts a parallel bit data fed from the CPU 11 through the bus line, into a corresponding serial bit data which is added with a start bit, a stop bit and a parity bit. The converted serial bit data is outputted to the infrared modem 21. Otherwise, the UART 22 operates reversely to receive a serial bit data from the infrared modem 21 and to detect therefrom a start bit with error checks to thereby convert the serial bit data into a corresponding parallel bit data. The infrared modem 21 modulates by FSK method the serial bit data inputted from the UART 22, a modulated result of which is outputted to an LED of the coupling member 20. Otherwise, the modem 21 demodulates an electric signal detected by an infrared photodiode of the coupling member 20, into a corresponding serial bit data. Such a two-way channel is utilized to exchange a control message or else between the player 1 and the loader 2.

The CPU 11 receives a directory file listing new entry songs through the fast one-way channel at the start of the data downloading operation. Then, the CPU 11 picks up or discriminates therefrom new songs which are not stored in its own HDD 12 to form a new song pickup list. The pickup list is returned to the loader 2 through the two-way channel under control by the UART 22. Lastly, the player receives song data files designated in the pickup list through the fast one-way channel.

The karaoke processing unit 14 includes sound means such as a tone generator operative based on the song data retrieved from the HDD 12 for sounding a karaoke accompaniment through a loudspeaker 26, graphic means for displaying lyric characters on a monitor 27 such as CRT together with a background picture reproduced by an external Laser Disc (LD) player 29, and mixing means for processing a voice signal inputted by a microphone 25 to apply an echo or other effects to thereby sound a live vocal performance mixed with the instrumental accompaniment through the loudspeaker 26. The karaoke processing unit 14 further accepts a request of an entry song inputted by a singer to pass an identification code of the requested song to the CPU 11. The CPU 11 retrieves the corresponding song data from the HDD 12, and sequentially feeds the same to the karaoke processing unit 14 while regulating timings according to a duration data contained in the song data.

Figure 4A:
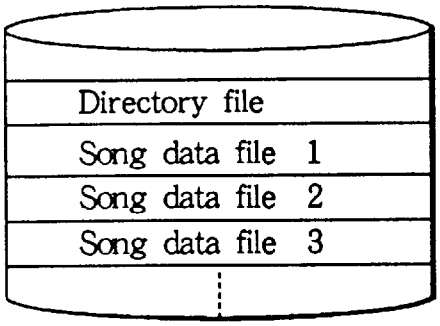
FIGS. 4A, 4B and 4C are a schematic diagram showing song data formats.

FIG. 4A shows a format of the song data stored in the primary and the secondary storages. The secondary HDD 12 of the player and the primary HDD 33 of the loader have the same storage structure which contains a song data memory area for memorizing numerous files (several hundreds to several thousands) of the song data, and a directory file which memorizes identification codes (file names) of the song data files stored in the data memory area.

Figure 4B:
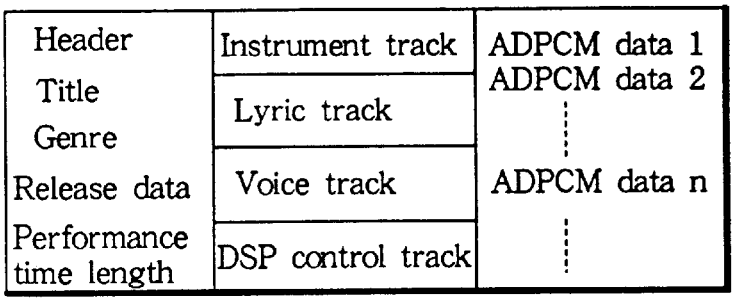

FIG. 4B schematically shows a format of one song data file which includes a header, an instrument track, a lyric track, a voice track, a digital sound field processing (DSP) control track and a voice data section. The header is written with various index data regarding the song such as a title, a genre, a release data, and a time length of performance. The instrument track is divided into subtracks corresponding to various parts of the instrumental accompaniment such as a piano part, a rhythm part and else. Each subtrack is written with a sequence of an event data and a duration data. The lyric track is written with a lyric data for use in displaying of lyric characters on the monitor. The lyric track does not contain a pure MIDI data. However, in order to integrate an overall implementation and to facilitate data processing, the lyric data is prescribed in a specific form of "system-exclusive-message" likewise the MIDI data which is written in the instrument track. The voice track is utilized to generate a voice of a back chorus or else, which would be hardly synthesized by a tone generator involved in the karaoke processing unit 14. The voice track is processed in combination with the voice data section so as to produce a back chorus sound or a harmony melody sound. The voice data section contains a plurality of ADPCM data sampled from a live chorus sound according to adaptive delta pulse code modulation. The voice track is written with a sequence of duration data and designation data. The duration data determines a timing when an ADPCM data is converted into an analog voice signal. The designation data is read out at that timing. The designation data designates one of the ADPCM data according to an assigned number 1, 2, . . . , n. Further, the DSP control track is written with a control data effective to control a digital sound field processor contained in the karaoke processing unit. The digital sound field processor is operated to impart a reverberation and other effects to the karaoke sound. The type and variation of the effect is progressively regulated according to the control data written in the DSP control track during the course of the karaoke performance.

Figure 4C:
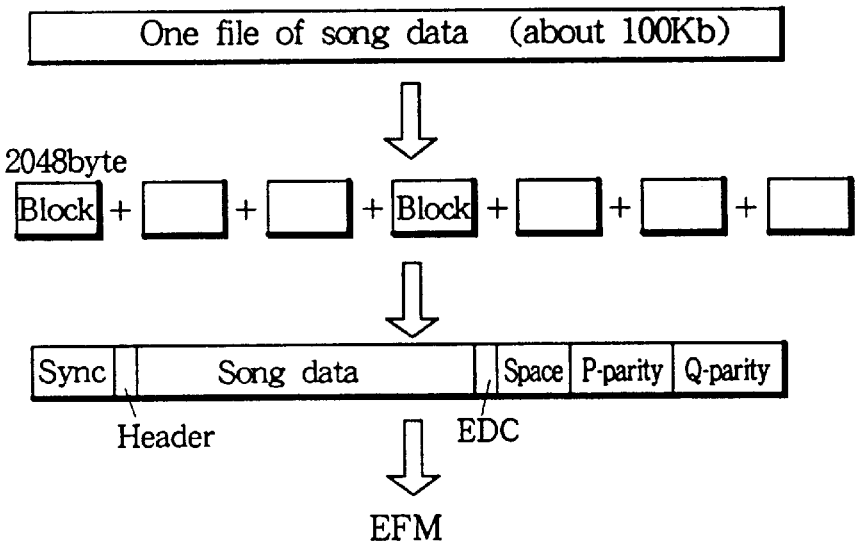

FIG. 4C shows a packet format of the song data to be transferred from the loader to the player. One file of the song data is composed of about 500 Kbytes. For example, the song data is divided into blocks each containing 2048 bytes so as to form a packet likewise CD-ROM format. Each block is added with a sync of 12 bytes and a header of 4 bytes at a top part, while an error detection code (EDC) of 4 bytes, an identification space of 8 bytes, a P-parity of 172 bits and a Q-parity of 104 bits are added at an end part of the block, thereby forming one packet. A train of the packets are modulated by the EFM method for transmission.

Next, the operation of the karaoke system will be described in conjunction with flowcharts of FIGS. 5 and 6. These flowcharts show the downloading operation of the song data from the loader 2 to the player 1. Normally, the karaoke player 1 reserves several hundreds to several thousands of the entry songs in the secondary storage, hence some of the reserved songs may be duplicative with original songs stored in the primary HDD 33 of the loader 2. In view of this, the karaoke player 1 initially receives the directory file of the original songs from the loader 2 so as to discriminate nonentry songs which are not stored in its own secondary HDD 12 so as to request only the downloading of the nonentry songs, thereby saving a data transfer time and a storage capacity.

Figure 5:
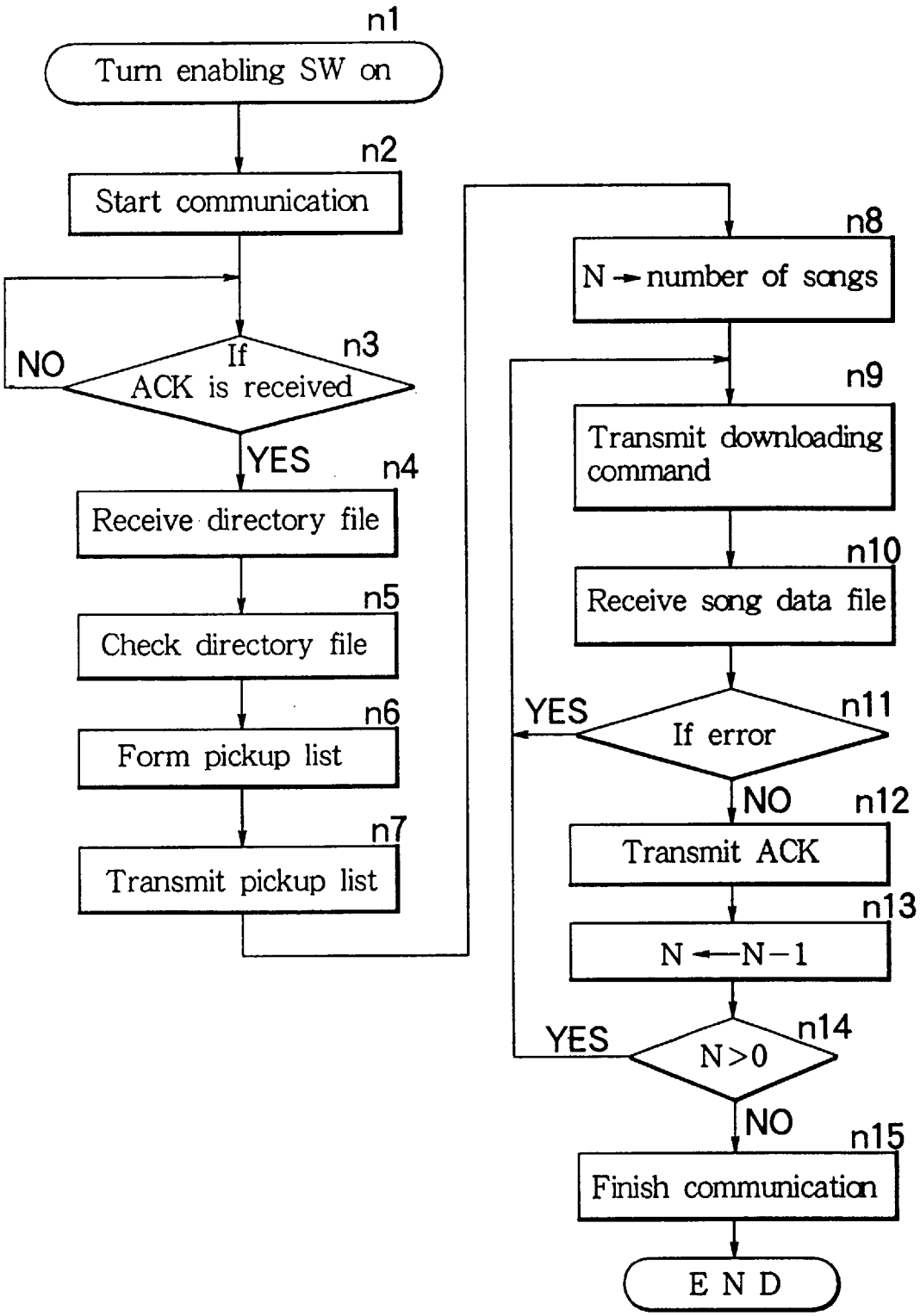
FIG. 5 is a flowchart showing operation of the karaoke player.

Referring now to FIG. 5 which shows the operation at the karaoke player 1, first the loader 2 is set on the top face of the karaoke player 1 in place, and the power switch 62 of the loader 2 is turned on, thereby establishing the coupled state. Then, Step n1 is undertaken to actuate the enabling switch 10 of the player 1 to thereby start the downloading operation. Subsequently to the turn-on of the enabling switch 10, Step n2 is undertaken to transmit an open command through the two-way channel so as to start the communication. Then, Step n3 is undertaken to check as to if an acknowledgement message ACK is returned by the loader 2. After the receipt of ACK, the player 1 further receives the directory file from the loader 2 in Step n4. The serving of the directory file is carried out through the one-way fast channel. Then, Step n5 is undertaken to compare the contents of the received directory file with those of the internal directory file stored in the secondary HDD 12. Further, Step n6 is undertaken to pick up nonentry songs which are found in the received external directory file but not found in the internal directory file, as the results of the comparison, to thereby form a pickup list. This pickup list is forwarded to the loader 2 through the two-way channel in Step n7. Next, Step n8 is undertaken to set a number of nonentry song pieces prescribed in the pickup list into a register N, thereby completing a preparation operation.

Thereafter, Step n9 is undertaken to pass a downloading command to the loader 2 through the two-way channel. In response to the downloading command, the loader 2 serves one file of the song data through the fast one-way channel, which is received by the player 1 in subsequent Step n10. Then, Step n11 is undertaken to check as to if the received data contains an error. If no error, an acknowledgement message (ACK) is forwarded to the loader 2 through the two-way channel in Step n12. Then, Step n13 is undertaken to decrement the register N by one. On the other hand, if the check result of Step n11 shows an occurrence of any error in the received song data file, Step n9 is called again to issue a recurrent downloading command. This routine may be repeatedly executed until the object file of the song data is safely received. The above described downloading of the song data file is executed one by one while Step n14 is undertaken to check as to if N>0. Lastly, when N reaches "0", the check result of Step n14 is turned NO. Consequently, Step 15 is undertaken to pass an end message to the loader 2 through the two-way channel to thereby notify the complete receipt of all the new songs.

Figure 6:
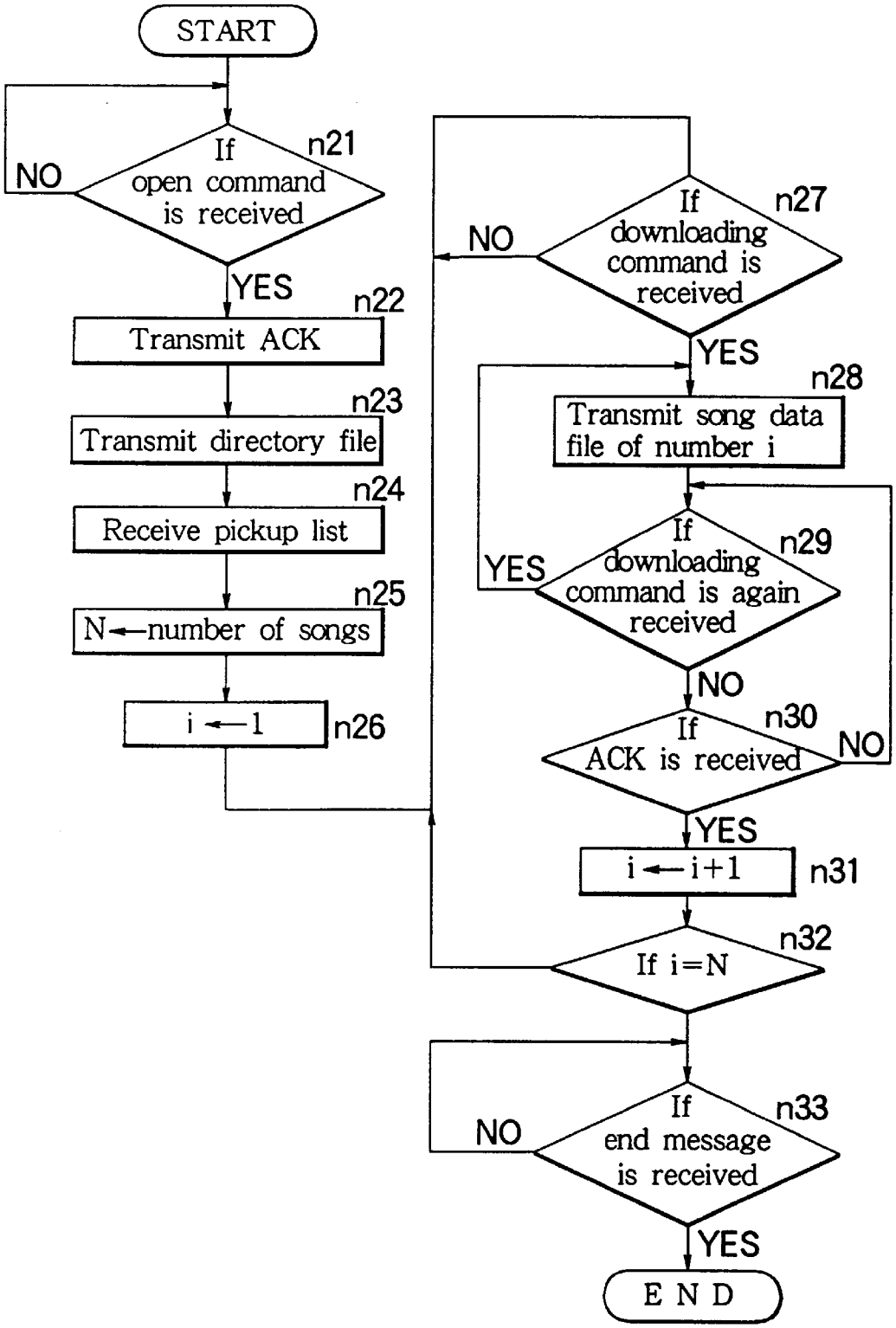
FIG. 6 is a flowchart showing operation of the data loader.

Referring to FIG. 6 showing the operation at the loader 2, initially the loader 2 is placed on the top face of the karaoke player 1 and the power switch is turned on. Then, Step n21 is undertaken as to if the communication open command is fed from the player 1. After waiting for the open command, Step n22 is undertaken to return an acknowledgement message (ACK) upon receipt of the open command. Thereafter, Step n23 is undertaken to transmit the directory file stored in the primary HDD 33 through the fast one-way channel. Subsequently in Step n24, the loader 2 receives the pickup list through the two-way channel. The number of songs prescribed in the pickup list is set in a register N by Step n25. Further, a song number counter i is preset to "1" in Step n26.

Thereafter, check is made in Step n27 as to if a downloading command from the player 1 is received. After waiting for the downloading command, Step n28 is undertaken to transmit a song data file of number "i" in the packet form upon the receipt of the downloading command. Subsequently, Step n29 is undertaken to watch as to if the karaoke player 1 again sends the same downloading command during or immediately after the transmission of each packet. When the same downloading command is sent again, preceding Step n28 is called to transmit again a whole of the same song data file or a part of the same song data file (one or more packets) which the karaoke player has failed to receive safely. On the other hand, when it is judged that the karaoke player 1 returns a receipt acknowledgement message (ACK) in Step n30, the song number counter i is incremented by "1" in Step n31 since the song data of number "i" is safely downloaded. This downloading operation is repeatedly carried out until Step n32 judges that the content i of the counter reaches N, thereby completing transmission of all the songs prescribed in the pickup list. Lastly, Step n33 is undertaken to confirm the receipt of the communication end message to finish the operation.

In the embodiment shown in FIGS. 1A and 1B, the song data loader 2 is placed on top of the karaoke player 1. However, in a public karaoke service facility such as a bar and club, a karaoke player is normally installed tightly and neatly such that the top face thereof is not allowed open. In most cases, the karaoke player is installed in a shelter or a slot such that only the front face panel thereof may be exposed. In view of this, another embodiment shown in FIG. 7 is designed such as to be connectable to the front face of the karaoke player.

Figure 7:
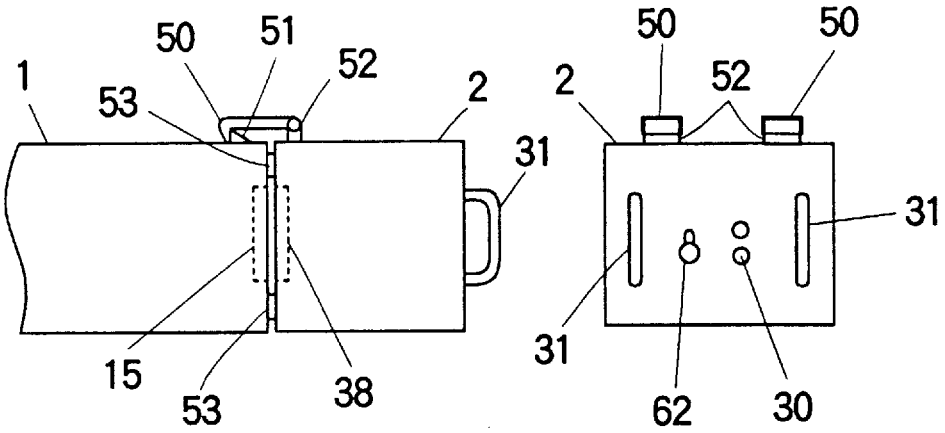
FIG. 7 is a structural diagram showing another embodiment of the inventive karaoke system.

Referring to FIG. 7, the karaoke player 1 has a photodetecting coupling member 15 and an additional photoemitting/photodetecting coupling member, which are located in a front face panel of the player housing. Further, a protrusion 51 is formed on a top face of the player 1 for engagement with the loader 2. On the other hand, the loader 2 has a photoemitting coupling member 38 and an additional photoemitting/photodetecting coupling member, which are located in a rear face of the loader casing. Further, a hook 50 is attached to a top face of the loader 2 for engagement with the protrusion 51 formed on the player 1. Moreover, a cushion 53 is disposed on the rear face of the loader 2 so as to avoid a damage of the front face panel of the karaoke player 1 when the loader 2 is opposed thereto. The hook 50 is rotatably supported by a pin 52 to facilitate the coupling of the loader 2 and the player 1. Namely, the hook 50 is engaged with the protrusion 51 while the loader 2 is held by means of the grip 31, and thereafter the cushion 53 is made contact with the front face panel of the karaoke player 1. Consequently, the loader 2 is fixed to the player 1 to enable the downloading of the song data in manner similar to the previous embodiment shown in FIGS. 1A and 1B.

In the disclosed embodiments, the player 1 compares the primary directory file of the loader 2 and its own secondary directory file with each other to enable selective downloading of nonentry songs which are not stored in the secondary HDD 12 of the karaoke player 1. Alternatively, the loader 2 may conduct the comparison of the primary and secondary directory files. Otherwise, without such a comparison, the loader 2 may determine items of songs to be downloaded regardless of the contents of the secondary storage of the player 1. In this case, the additional two-way channel may be eliminated from the player 1 and the loader 2. The disclosed system adopts the separate two-way channel utilizing the UART for exchanging control messages in view of the simple circuit structure. However, in modification, the fast one-way channel may be replaced by a fast two-way channel to concurrently transfer the song data and the control messages. The disclosed system adopts the transfer of the song data by means of the infrared carrier wave. However, the infrared wave can be replaced by an electromagnetic wave. In such a case, the transmitter and the receiver can be coupled to each other in close contact manner so that a power of the electromagnetic wave can be set in a quite weak range outside any administrative regulations. Further, the disclosed system is comprised of the karaoke player of the stand-alone type which does not have an online communication interface. However, the invention can be applied to the karaoke player of the online type which is connected to a host station through a communication network such as Integrated Services Digital Network (ISDN) to receive therefrom song data. In such a case, the portable loader is utilized as a supplementary or secondary source of the song data. Additionally, either of the loader 2 and the player 1 may be provided with an indicator for displaying a number of the served new songs, which is used for calculation of a service charge.

As described above, according to the first aspect of the invention, the data loader is simply set on the karaoke player to carry out the downloading of the song data through the wireless coupler, thereby eliminating a cable connecter such as an SCSI cable to facilitate the downloading work. Further, the wireless coupler can suppress a contact failure which would occur by contamination or moisture involved in a public karaoke service facility, thereby securing the correct transfer of the song data. Moreover, the loader can selectively serve nonentry songs which are not reserved in the karaoke player, thereby saving the downloading time. Additionally, the separate two-way wireless coupler is provided to exchange control messages between the loader and the player, thereby enabling synchronous downloading of the song data to reduce a working volume.

Figure 8:
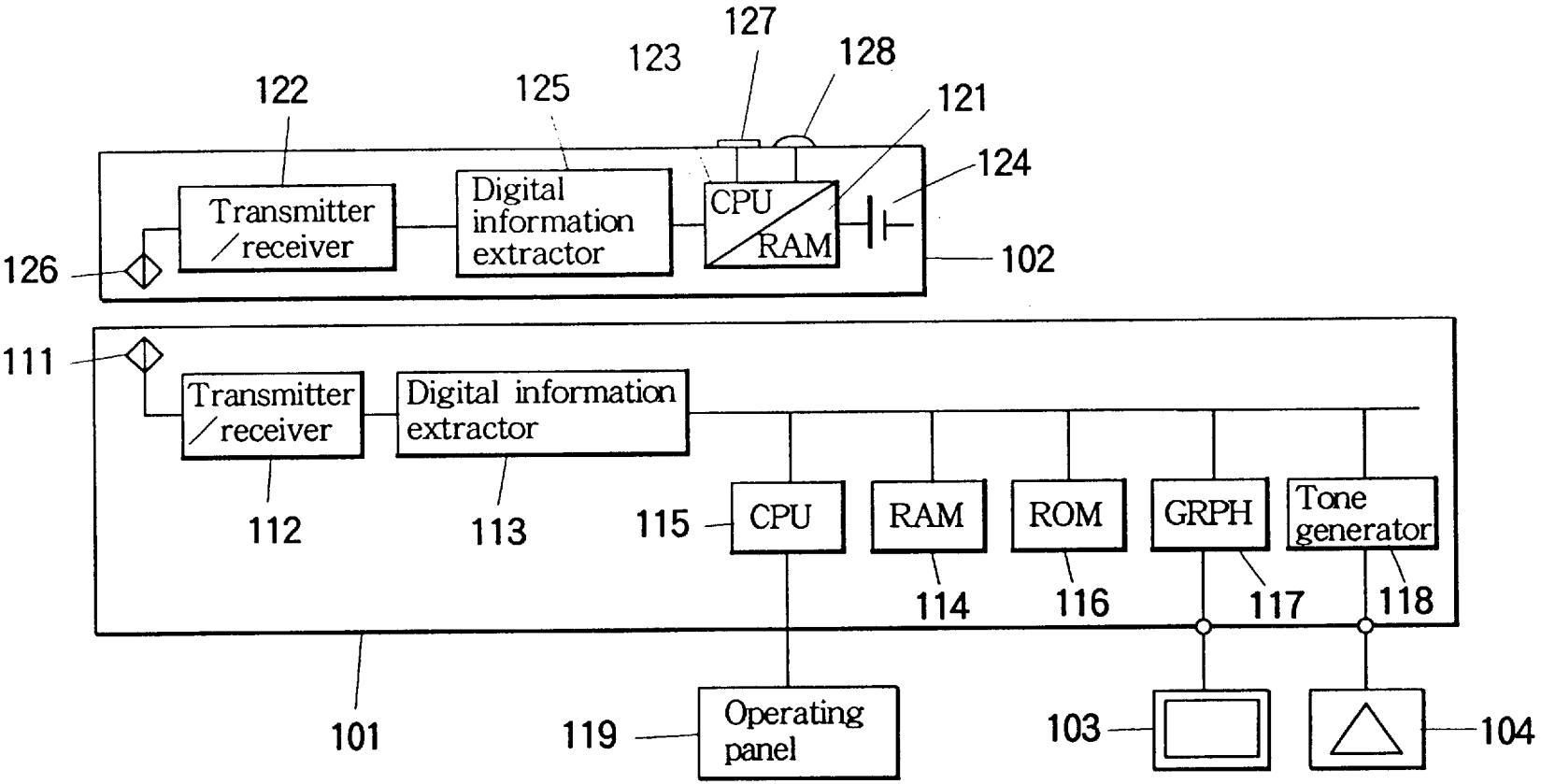
FIG. 8 is an overall block diagram showing one embodiment of the inventive amusement system.

Referring next to FIG. 8, detailed description is given to the second aspect of the invention. The amusement system is comprised of a main playing machine or an amusement player 101 which functions as a TV game machine, an electronic musical instrument machine or a synthetic karaoke machine, and a separate information loading machine or a loader 102 which is connectable to the player 101 through a wireless coupler. The amusement system includes a plurality of loaders, one of which is selectively set on the player 101 without physical wire connection so as to download a desired item of the information containing a program and/or a data through the wireless coupler. In this embodiment, the player 101 and the loader 102 are coupled to each other through a two-way type of the wireless coupler.

The loader 102 is comprised of a storage medium such as a RAM 121 for storing information, a transmitter/receiver 122 operable to transmit the information retrieved from the RAM 121 by means of a very weak electromagnetic wave or a radio wave, and a CPU 123 for controlling the RAM 121 and the transmitter/receiver 122. The loader 102 further includes a power source 124 for powering the entire of the loader 102 and for serving as a backup power supply of the RAM 121, a digital information extractor 125 for extract received information from the transmitter/receiver 122, one coupling member composed of an antenna 126 for emitting and collecting a radio wave, a start switch 127 for commencing the information transmission, and a pilot lamp 128 indicative of a communication state.

The amusement player 101 is comprised of another coupling member composed of an antenna 111 which can be placed to confront the counter antenna 126 to form the wireless coupler of the two-way mode, a transmitter/receiver 112 operable to receive the radio wave which is transmitted from the loader 102 and which carries the downloaded information, a digital information extractor 113 for extracting the information from the received carrier radio wave, a RAM 114 for memorizing the extracted information, a central processing unit (CPU) 115 for processing the information memorized in the RAM 114 so as to present a desired kind of play. The player 101 further includes a ROM 116 for storing a basic operation program needed by the CPU 115, a graphic memory (GRPH) 117 such as a VRAM for developing an image data contained in the served information, and a tone generator 118 for converting a MIDI data contained in the served information into a musical tone signal. The player 101 is connected to output devices such as a monitor 103 which displays a graphic image according to the image data developed in the graphic memory 117 and a loudspeaker 104 driven by the tone generator 118. The player 101 is connected to an input device such as an operating panel 119 which inputs various commands to the CPU 115.

In operation, the CPU 115 of the player 101 processes the information containing an application program and/or a data which are developed on the RAM 114. The basic operation program is supplied to the CPU 115 from the ROM 116. In case that the amusement player works as a karaoke playing machine, the selected one of loaders serves a karaoke item of the information containing a song data in the form of a MIDI data or else, which is received by the player 101 and memorized in the RAM 114. In the downloading of the song data, the antenna 126 disposed in a casing of the loader 102 is opposed to the counter antenna 111 disposed in a housing of the player 101. Then, the transmission start switch 127 is turned on, while the operating panel 119 is concurrently actuated to place the player 101 in an active open state. Otherwise, the player 101 may be always held in the open state such as to automatically receive the song data fed from the loader 102 to thereby rewrite the RAM 114 by the received data. The loader 102 transmits the song data, which is received by the player 101 and is memorized in the RAM 114.

When the downloading of the song data is completed, the player 101 is decoupled from the loader 102 to restore a regular operation state. Incidentally when the operating panel 119 is actuated to input a karaoke play request, the CPU 115 retrieves the song data from the RAM 114 and distributes an accompaniment data contained in the retrieved song data to the tone generator 118. The tone generator 118 sequentially generates a musical tone signal according to the accompaniment data so that the loudspeaker 104 is driven to sound a karaoke accompaniment. Further, the CPU 115 converts a lyric data contained in the retrieved song data into a character data, which is then developed on the graphic memory 117. Consequently, the monitor 103 can display the lyric characters. Moreover, the player 101 displays a dynamic background picture in superposed relation to the lyric characters on the monitor 103. For this, the loader 102 may serve the song data containing a dynamic image data. Alternatively, the served song data may contain a frame code data so that the player 101 accesses an external record medium such as a Laser Disc according to the frame code data to reproduce a dynamic background image. Additionally, when the amusement player works as the karaoke machine, a microphone and a mixing device are externally connected to input a live vocal performance into the loudspeaker 104. In case that the amusement player works as an electronic musical instrument, the monitor 103 may be eliminated. In case that the amusement player works as a TV game machine, required output and input devices may be substantially the same as those required in the karaoke machine.

According to the invention, the downloading is carried out through the wireless coupler between the player 101 and the loader 102. Therefore, the loader 102 is made free of a cable connector or else, nor does require connecting work of the cable connector. More advantageously, a shape and an appearance of the casing of the loader 102 can be freely designed since there is no physical or mechanical restriction for a coupling structure. Thus, the casing of the loader is formed in a peculiar shape associated to the item of the stored information, thereby enabling a ready selection of the loader and realizing an attractive design.

Figure 9:
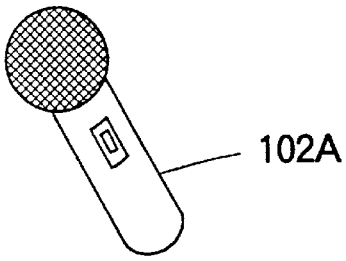
FIGS. 9–12 are a schematic diagram showing various shapes of a spare loader prepared in the inventive amusement system.
Figure 10:
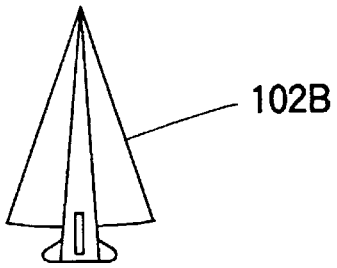
Figure 11:
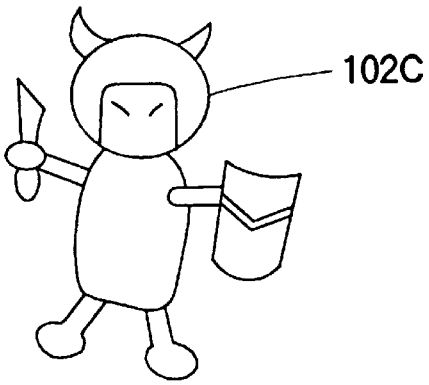
Figure 12:
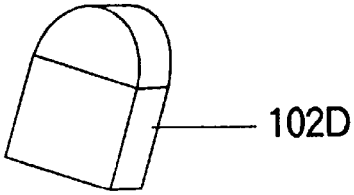

For example, as shown in FIG. 9, the loader 102A storing a karaoke song data has a casing of a microphone-shape accommodating therein the storage medium and other circuit components. In case of downloading a game item of the information containing a game program and/or game data, the loader may have a peculiar appearance which indicates the game item. For example, a loader 102B shown in FIG. 10 has a casing of a rocket-shape associative of a shooting game. Another loader 102C shown in FIG. 11 has a casing of a doll-shape associative of a role playing game (RPG). In one variation, a loader 102D shown in FIG. 12 has a casing of an eraser-shape, which serves a data clear program effective to erase the data previously stored in the RAM 114 of the player 101. The shape and appearance of the loader 102D readily indicates an eraser to thereby avoid inadvertent selection of the data clear program.

As described above, according to the second aspect of the invention, the loader downloads data and/or program to the player by means of a carrier radio wave or else so that the loader is not required to mechanically connect to the player, thereby facilitating the downloading work and simplifying the structure of the loader. More importantly, the casing of the loader can be freely formed in an impressive shape associated to the item of the information stored therein.

What is claimed is:

1. A karaoke system comprising:

a player installed in a location for providing a karaoke accompaniment according to data representative of a song selected in response to a request; and a portable loader capable of being carried to the location and detachably coupled to the player for downloading thereinto data representative of a song, wherein the portable loader comprises:

a casing having a first face;

a first coupling member disposed in the first face;

a primary memory disposed in the casing for storing data representative of a plurality of songs; and a transmitter for retrieving the data representative of songs from the primary memory to transmit the same through said first coupling member, wherein the player comprises:

a housing having a second face arranged so as to engage with the first face in opposed relation thereto when the loader is coupled to the player;

a second coupling member disposed in the second face in opposed relation to said first coupling member to thereby form a wireless communication channel in the coupled state;

a secondary memory disposed in the housing;

a receiver for receiving the data representative of the songs transmitted through the wireless communication channel to store the same into the secondary memory; and a sound generator responsive to a request for selectively retrieving data representative of a desired song data from the secondary storage so as to sound the karaoke accompaniment.

2. A karaoke system according to claim 1, the karaoke system further including a circuit disposed in one of the player and the loader for monitoring the contents of the primary memory and the secondary memory to detect data representative of a new song which is stored in the primary memory but not stored in the secondary memory, and for controlling the transmitter to selectively transmit the data representative of the new song from the loader to the player through the wireless communication channel.

3. A karaoke system according to claim 1, the karaoke system further including a bi-directional wireless communication channel formed between the player and the loader for exchanging a control message effective to control the downloading of the data representative of songs.

4. A karaoke system according to claim 1, wherein said first coupling member comprises a photoemitter for emitting an optical signal modulated by data representative of songs, and said second coupling member comprises a photodetector for receiving the optical signal to thereby extract the data representative of songs.

5. A karaoke system according to claim 1, wherein said first coupling member comprises a first antenna for transmitting an electromagnetic signal modulated by the data representative of songs, and said second coupling member comprises a second antenna for receiving the electromagnetic signal, wherein the wireless communication channel is formed when the antennae are brought in close proximity.

6. An amusement system comprising:

a player for providing a play according to information containing at least one of a program and data, and a plurality of loaders selectively coupled to the player for downloading different items of the information, wherein each loader comprises:

a memory medium for storing at least one item of the information;

a casing for accommodating the memory therein, the casing being formed in one of a plurality of shapes, the particular shape of the casing visually indicating the corresponding item of the stored information to enable ready selection of a desired loader, the casing including:

a first coupling member disposed on the casing; and a transmitter for transmitting the item of the information stored in the memory through said one coupling member, and wherein the player comprises:

a second coupling member arranged so as to engage said first coupling member to thereby form a wireless communication channel when a selected one of the loaders is coupled to the player, a receiver for receiving the transmitted item of the information through the wireless communication channel; and a processor for processing the received item of the information to provide a desired kind of the play.

7. An amusement system according to claim 6, wherein the processor comprises a circuit for selectively providing one of a karaoke play, a game play and an instrument play according to the downloaded item of the information.

8. A loader connectable to a player for downloading thereinto information representative of at least one of a program and data to enable the player to provide a desired performance responsive to the information, the loader comprising:

a memory for storing the information;

a casing for accommodating the memory therein, the casing being formed in one of a plurality of shapes, the particular shape of the casing visually corresponding to the performance to be provided by the player;

a coupling member disposed on the casing so as to form a wireless communication channel with the player; and a transmitter for transmitting the information stored in the memory to the player through the wireless communication channel.

* * * * *